US012782033B2

(12) United States Patent
Park et al.

(10) Patent No.: US 12,782,033 B2
(45) Date of Patent: Nov. 3, 2026

(54) INDUCTION HEATING APPARATUS AND METHOD FOR CONTROLLING INDUCTION HEATING APPARATUS

(71) Applicant: LG ELECTRONICS INC., Seoul (KR)

(72) Inventors: Wongyu Park, Seoul (KR); Bada Yoon, Seoul (KR); Kyelyong Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 645 days.

(21) Appl. No.: 17/586,007

(22) Filed: Jan. 27, 2022

(65) Prior Publication Data

US 2022/0235993 A1 Jul. 28, 2022

(30) Foreign Application Priority Data

Jan. 27, 2021 (KR) ..... 10-2021-0011743

(51) Int. Cl.
*H05B 6/06* (2006.01)
*F25D 17/08* (2006.01)
(Continued)

(52) U.S. Cl.
CPC ..... *F25D 17/08* (2013.01); *F25D 21/006* (2013.01); *F25D 21/04* (2013.01); *F25D 21/08* (2013.01);
(Continued)

(58) Field of Classification Search
CPC ..... F25D 17/08; F25D 21/006; F25D 21/04; F25D 21/08; F25D 2317/067; F25D 2321/00; H05B 2213/05; H05B 6/062
(Continued)

(56) References Cited

U.S. PATENT DOCUMENTS 10,433,375 B2 10/2019 Lomp et al.
2011/0031989 A1 2/2011 Llona et al.
(Continued)

FOREIGN PATENT DOCUMENTS

EP 2 871 915 B1 3/2019
KR 10-2019-0001200 1/2019
(Continued)

OTHER PUBLICATIONS

Extended European Search Report dated Jun. 22, 2022 issued in Application 22153722.8.
(Continued)

*Primary Examiner* — Quang T Van
(74) *Attorney, Agent, or Firm* — KED & ASSOCIATES, LLP

(57) ABSTRACT

The method for controlling an induction heating apparatus comprising steps of determining whether a container detection start condition is satisfied; performing a first container detection operation for a heating area when the container detection start condition is satisfied; performing a second container detection operation for the heating area when it is determined that a container is present in the heating area based on the result of the first container detection operation; and driving a working coil corresponding to the heating area when it is determined that the container is a heatable container based on the result of the second container detection operation.

14 Claims, 12 Drawing Sheets

(51) Int. Cl.
*F25D 21/00* (2006.01)
*F25D 21/04* (2006.01)
*F25D 21/08* (2006.01)

(52) U.S. Cl.
CPC .... *F25D 2317/067* (2013.01); *F25D 2321/00* (2013.01)

(58) Field of Classification Search
USPC ..... 219/621, 622, 600, 623, 624, 625, 626, 219/630, 634, 650
See application file for complete search history.

(56) References Cited

U.S. PATENT DOCUMENTS

| | | | | |
|---|---|---|---|---|
| 2015/0008216 | A1* | 1/2015 | Pippia | H05B 1/0266 219/664 |
| 2018/0376543 | A1 | 12/2018 | Kang et al. | |
| 2018/0376546 | A1 | 12/2018 | Jang et al. | |
| 2019/0141793 | A1 | 5/2019 | Yoon et al. | |

FOREIGN PATENT DOCUMENTS

| | | | | |
|---|---|---|---|---|
| KR | 102069582 | B1 * | 1/2020 | H05B 6/062 |
| KR | 10-2020-0058240 | | 5/2020 | |
| WO | WO-2024127618 | A1 * | 6/2024 | A24F 40/46 |

OTHER PUBLICATIONS

Korean Office Action issued in Application No. 10-2021-0011743 dated Mar. 14, 2025.

* cited by examiner

INDUCTION HEATING APPARATUS AND METHOD FOR CONTROLLING INDUCTION HEATING APPARATUS

TECHNICAL FIELD

The present disclosure relates to an induction heating apparatus and a method for controlling the induction heating apparatus.

BACKGROUND

An induction heating apparatus is a mechanism that heats a container by generating an eddy current in a metal container, using a magnetic field generated around a working coil. When the induction heating apparatus is driven, an alternating current may be applied to the working coil. Accordingly, an induction magnetic field may be generated around the working coil disposed in the induction heating device. When a magnetic force line of the induced magnetic field generated in this way passes through the bottom of the container having a metal component placed on the working coil, an eddy current may be generated inside the bottom of the container. When the eddy current generated in this way flows through the container, the container itself may be heated.

If no container is placed on the heating area corresponding to the working coil or the working coil is driven in a non-magnetic state, there is a possibility that the circuit supplying current to the working coil may malfunction, and a loud noise is likely to occur during the operation. Accordingly, the induction heating apparatus has a function of determining whether a container or vessel is present or the container or vessel is heatable.

FIG. 1 is a circuit diagram of an induction heating apparatus according to prior art. Referring to FIG. 1, the induction heating apparatus 7 according to the prior art may include four working coils 722, 724, 726*a* and 726*b*. Two (722 and 724) of the four working coils are respectively disposed to correspond to different heating areas, for example, a first heating area and a second heating area. In contrast, the other two working coils 726*a* and 726*b* are disposed to correspond to one heating area, for example, a third heating area. For example, the two working coil 726*a* and 726*b* may each share a center and may be an inner working coil 726*a* and an outer working coil 726*b* having different diameters.

In addition, the induction heating apparatus 7 according to the prior art may include a first rectifier circuit 702, a first smoothing circuit 704, a first inverter circuit 712 and a second inverter circuit 714.

The first rectifier circuit 702 may include a plurality of diodes. The first smoothing circuit 704 may include a first inductor L1 and a first DC link capacitor C1.

The first inverter circuit 712 may include two switching elements SW1 and SW2 and two capacitors C2 and C3. The second inverter circuit 714 may include two switching elements SW3 and SW4 and two capacitors C4 and C5.

When switching signals S1, S2, S3 and S4 are supplied based on the control of a controller (not shown), the first inverter circuit 712 and the second inverter circuit 714 may respectively receive input of currents via the first rectifier circuit 702 and the first smoothing circuit 704 and convert the input currents, to transmit the converted currents to the first working coil 722 and the inner working coil 726*a*.

The induction heating apparatus 7 according to the prior art may also include a second rectifier circuit 706, a second smoothing circuit 708, a third inverter circuit 716 and a fourth inverter circuit 718.

The second rectifier circuit 702 may include a plurality of diodes. The second smoothing circuit 706 may include a second inductor L2 and a second DC link capacitor C6.

The third inverter circuit 716 may include two switching elements SW5 and SW6 and two capacitors C7 and C8. The fourth inverter circuit 718 may include two switching elements SW7 and SW8 and two capacitors C9 and C10.

When switching signals S5, S6, S7 and S8 are supplied based on the control of the controller (not shown), the third inverter circuit 716 and the fourth inverter circuit 718 may respectively receive input of currents via the second rectifier circuit 706 and the second smoothing circuit 708 and convert the input currents, to transmit the converted currents to the second working coil 724 and the outer working coil 726*b*.

FIG. 2 illustrates the output voltage of the first DC link capacitor, the driving state of the first working coil and the inner working coil, and the output voltage of the second DC link capacitor, the driving state of the second working coil and the outer working coil, when the induction heating apparatus shown in FIG. 1 performs a heating operation, respectively. In FIG. 2, ON means a state in which the working coil is being driven and OFF means a state in which the working coil is not driven.

In the embodiment shown in FIG. 2, the first working coil 722 disposed to correspond to the first heating area and the inner working coil 726*a* and the outer working coil 726*b* disposed to correspond to the third heating area may be being driven and heating the container, but the second working coil 724 disposed to correspond to the second heating area may not be being driven. In this state, when the container placed in the first heating area is removed from the first heating area by the user, the controller (not shown) may perform container detection for the first heating area.

Once the container detection operation for the first heating area starts, the controller (not shown) may set the driving frequency of the first working coil 722 to a predetermined sensing frequency (e.g., 65 kHz). The controller (not shown) may determine whether a heatable container is present in the first heating area based on at least one of an input current value and a resonance current value measured while driving the first working coil 722 based on the sensing frequency. At this time, the inner working coil 726*a* sharing the first rectifier circuit 702 and the first smoothing circuit 704 with the first working coil 722 is being driven at a predetermined driving frequency different from the sensing frequency. Accordingly, the controller (not shown) may temporarily stop the driving of the inner working coil 726*a* for a predetermined first sensing time t1 to t3 and drive the first working coil 722 based on the sensing frequency.

If it is determined that a heating container is present in the first heating area based on the result of the container detection performed for the first detection time t1 to t3, the container detection operation may not be performed any more. However, if the state in which there is no heatable container in the first heating area is continuously maintained, the container detection operation may be periodically and repeatedly performed for a predetermined number of times or for a predetermined time period. In one embodiment shown in FIG. 2, for example, the driving of the inner working coil 726*a* may be stopped even in a second sensing time t4 to t6 and a third sensing time t7 to t9, and the first working coil 722 may be driven based on the sensing frequency.

When the driving of the inner working coil 726*a* is stopped, the driving of the outer working coil 726*b* disposed in the same third heating area may be also stopped at the sane timing.

When the container detection operation is periodically performed, the rectifier circuit 702 and the first smoothing circuit 704 may continuously supply power to the first inverter circuit 712 or the second inverter circuit 714. Accordingly, as shown in FIG. 2, the output voltage of the first DC link capacitor may not be deformed but maintained as a constant waveform.

However, when the driving of the outer working coil 726*b* together with the inner working coil 726*a* is stopped, the second rectifier circuit 706 and the second smoothing circuit 708 may not supply power to the third inverter circuit 716 or the fourth inverter circuit 718 for the sensing time (t1~t3, t4~t6 and t7~t9). Accordingly, the voltage of the second DC link capacitor C6 may not be completely discharged at time points t2, t5 and t8 while the container detection operation for the first heating area is performed, but the voltage may be re-charged to the second DC link capacitor C6.

Hence, a large noise could be generated as the voltage charged in the second DC link capacitor C6 is rapidly discharged at the time points t3, t6 and t9 when the container detection operation for the first heating area is terminated and the driving of the inner working coil 726*a* and the outer working coil 726*b* is resumed. Accordingly, if a state in which no heatable container exists in the first heating area is continuously maintained, a loud noise might be repeatedly generated whenever the container detection operation is performed.

Although not shown in the drawings, the above-described container detection operation may be performed in the same manner even after the user sets a power level for the heating area and a heating start command is input. Accordingly, when the state in which there is not heatable container in the heating area is continuously maintained after the user inputs the input the heating start command, the above-described container detection operation may be repeatedly performed and a loud noise might be repeatedly generated due to the rapid discharge of the DC link capacitor.

As mentioned above, according to the prior art such a loud noise is repeatedly generated due to the repeated performances of the container detection operation when a state in which no heatable container exists in the heating area is continuously maintained during or at the start of the driving of the working coil disposed in the position corresponding to the heating area. Such noise has a problem of causing a use to feel a great discomfort in the process of using the induction heating device or causing the user to mistakenly believe that the induction heating device has a malfunction.

In addition, according to the prior art, the container detection operation is repeatedly performed for the predetermined time when the state in which no heatable container exists in the heating area is maintained. Accordingly, there may be a disadvantage in that a lot of power is consumed for container detection.

SUMMARY

One object of the present disclosure is to provide an induction heating apparatus that may reduce the number of container detections performed when a container placed in a heating area is not a heatable container, thereby reducing the noise generated in the container detection operation and power consumption for the container detection, and a method for controlling the induction heating apparatus.

Furthermore, another object of the present disclosure is to provide an induction heating apparatus that may quickly notify a user that cooking is impossible, when no container is placed in a heating area or a container placed in the heating area is not a heatable container, and a method for controlling the induction heating apparatus.

Aspects according to the present disclosure are not limited to the above ones, and other aspects and advantages that are not mentioned above can be clearly understood from the following description and can be more clearly understood from the embodiments set forth herein. Embodiments of the present disclosure may provide a method for controlling an induction heating apparatus comprising steps of: determining whether a container detection start condition is satisfied; performing a first container detection operation for a heating area when the container detection start condition is satisfied; performing a second container detection operation for the heating area when it is determined that a container is present in the heating area based on the result of the first container detection operation; and driving a working coil corresponding to the heating area when it is determined that the container is a heatable container based on the result of the second container detection operation.

The step of determining whether the container detection start condition is satisfied may include a step of determining that the container detection start condition is satisfied when a heating start command for the heating area is input.

The step of determining whether the container detection start condition is satisfied may include a step of determining that the container detection start condition is satisfied when an output power value of the working coil corresponding to the heating area decreases as much as a predetermined reference ratio.

The step of performing the first container detection operation may include steps of: supplying sensing current having a predetermined amplitude and size to the working coil; converting a resonance signal generated when the sensing current is supplied into a square wave; and determining whether a container is present in the heating area based on the number of the square waves.

The step of performing the second container detection operation may include steps of: setting a driving frequency of the working coil to a predetermined sensing frequency; and determining whether the container is a heatable container based on at least one of the resonance current value or an input current value measured when the working coil is driven based on the sensing frequency.

The method for controlling the induction heating apparatus may further include a step of performing a detection failure notification operation when it is determined that no container is present in the heating area or the container is not a heatable container based on the result of the first container detection operation.

Embodiments of the present disclosure may also provide an induction heating apparatus comprising a working coil disposed in a position corresponding to a heating area; an inverter circuit comprising a plurality of switching elements and configured to supply current to the working coil; a drive circuit configured to supply switching signals to respective switching elements provided in the inverter circuit; and a controller configured to determine a driving frequency of the working coil and supply a control signal to the drive circuit based on the driving frequency, thereby driving the working coil, The controller may determine whether a container start condition is satisfied, and perform a first container detection operation for a heating area when the container detection start condition is satisfied, and perform a second container detection operation for the heating area when it is determined that a container is present in the heating area based on the result of the first container detection operation, and drive a working coil corresponding to the heating area when it is determined that the container is a heatable container based on the result of the second container detection operation.

The controller determines that the container detection start condition is satisfied when a heating start command for the heating area is input.

The controller may determine that the container detection start condition is satisfied when an output power value of the working coil corresponding to the heating area decreases as much as a predetermined reference ratio.

The step of performing the first container detection operation performed by the controller may include steps of supplying sensing current having a predetermined amplitude and size to the working coil; converting a resonance signal generated when the sensing current is supplied into a square wave; and determining whether a container is present in the heating area based on the number of the square waves.

The step of performing the second container detection operation performed by the controller may include steps of setting a driving frequency of the working coil to a predetermined sensing frequency; and determining whether the container is a heatable container based on at least one of the resonance current value or an input current value measured when the working coil is driven based on the sensing frequency.

The controller may perform a detection failure notification operation when it is determined that no container is present in the heating area or the container is not a heatable container based on the result of the first container detection operation.

According to one embodiment of the present disclosure, the induction heating apparatus may reduce the number of container detections performed when a container placed in a heating area is not a heatable container, thereby reducing the noise generated in the container detection operation and power consumption for the container detection.

According to one embodiment of the present disclosure, the induction heating apparatus that may quickly notify a user that cooking is impossible, when no container is placed in a heating area or a container placed in the heating area is not a heatable container.

BRIEF DESCRIPTION OF DRAWING

The accompanying drawings constitute a part of the specification, illustrate one or more embodiments in the disclosure, and together with the specification, explain the disclosure, wherein.

DETAILED DESCRIPTION

Figure 1:
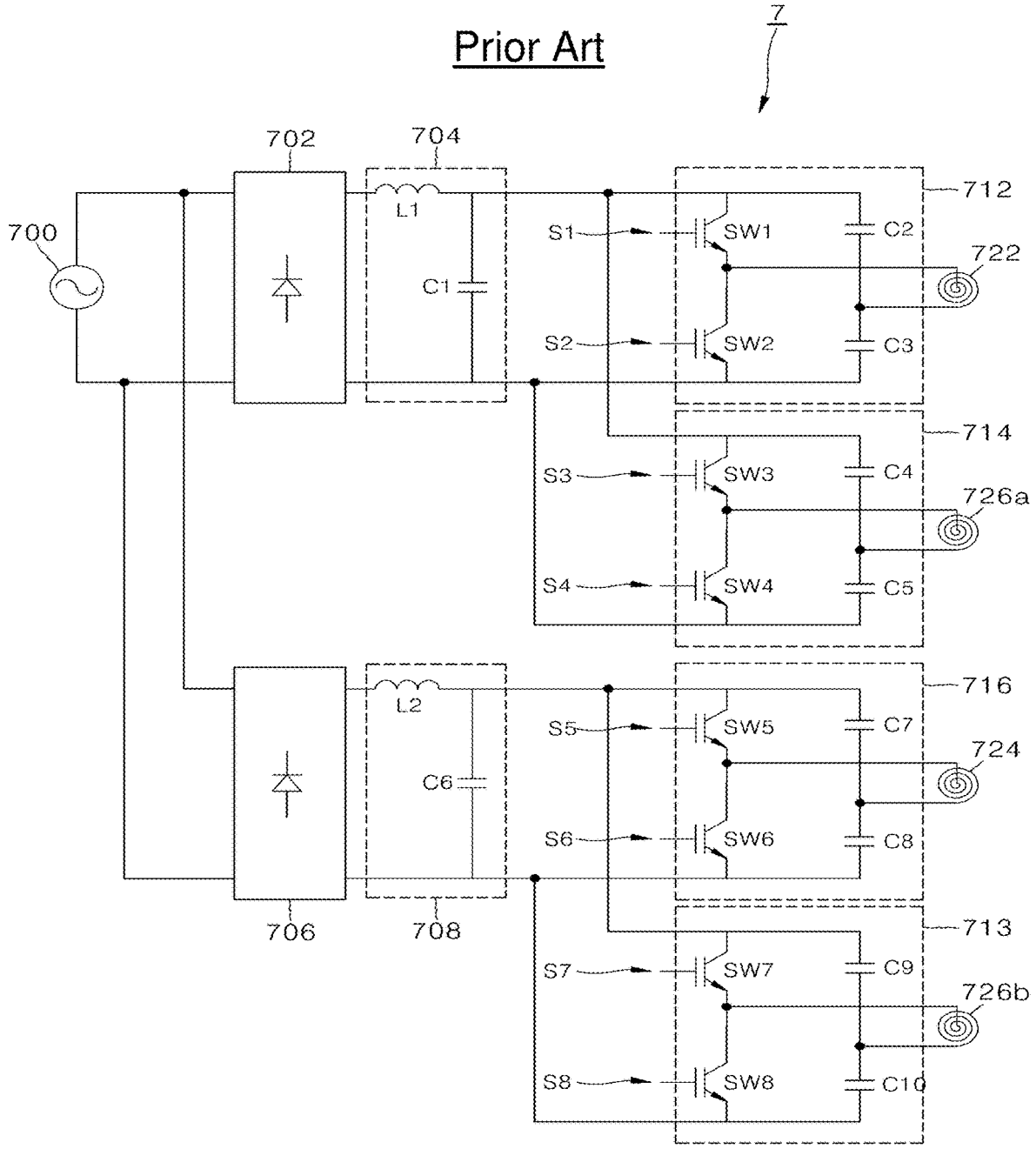
FIG. 1 is a circuit diagram of an induction heating apparatus according to the prior art.
Figure 2:
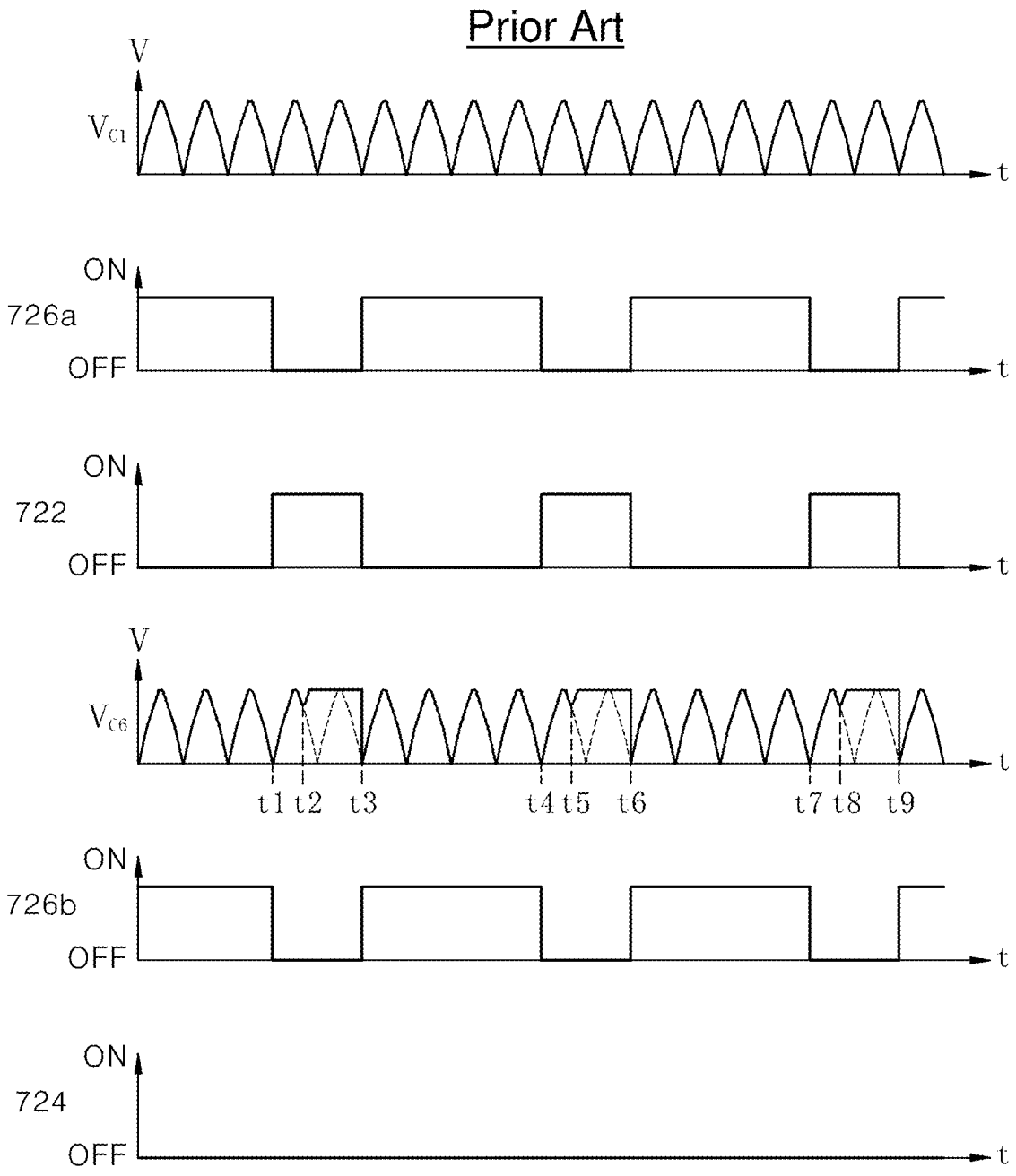
FIG. 2 is a diagram illustrating output voltage of a first DC link capacitor, a driving state of a first working coil and an inner working coil, and output voltage of a second DC link capacitor, a driving state of a second working coil and an outer working coil, when the induction heating apparatus shown in FIG. 1 performs a heating operation, respectively.
Figure 3:
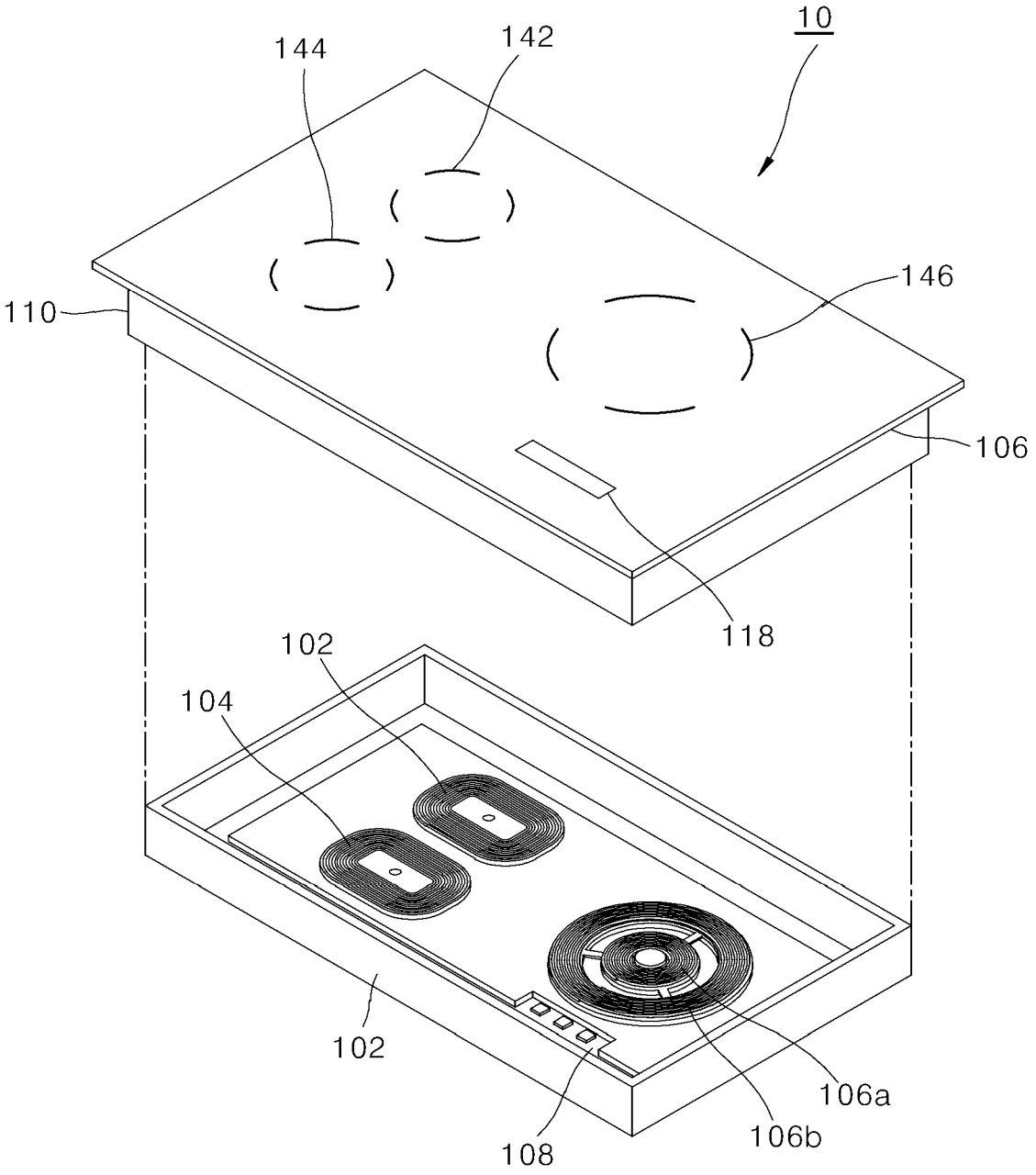
FIG. 3 is an exploded perspective diagram of an induction heating apparatus according to one embodiment of the present disclosure.

FIG. 3 is an exploded perspective diagram of an induction heating apparatus according to one embodiment of the present disclosure.

Referring to FIG. 3, the induction heating apparatus 10 according to one embodiment may include a case 102 defining a main body, and a cover plate 110 coupled to the case 102 and sealing the case 102.

A bottom surface of the cover plate 110 may be coupled to an upper surface of the case to close the space formed in the case 102 from the outside. A top plate 106, on which an object to be heated (i.e., a container for cooking food) is placed, may be formed on the upper surface of the cover plate 110. The top plate 106 may be made of a tempered glass material such as ceramic glass, but is not limited thereto.

Working coils 102, 104, 106*a* and 106*b* for heating a container or vessel may be disposed in a space inside the case formed by coupling the cover plate 110 to the case 102. Specifically, inside the case 102 may be disposed a first working coil 102, a second working coil 104, an inner working coil 106*a* and an outer working coil 106*b*.

In the embodiment shown in FIG. 3, the first working coil 102 may be disposed in a predetermined position corresponding to a first heating area and the second working coil 104 may be disposed in another predetermined position corresponding to a second heating area 144. The inner working coil 106*a* and the outer working coil 106*b* may be disposed to correspond to a third heating area 146. The inner working coil 106*a* and the outer working coil 106*b* may share a center and have difference diameters.

As shown in FIG. 3, the first working coil 102 and the second working coil 104 may have a rectangular shape with curved corners, respectively. The third working coil 106*a* and 106*b* may be configured in a circular shape, but the shape of each working coil may vary according to embodiments. For example, the first working coil 102 and the second working coil 104 may be formed in a circular shape.

The first heating area 142, the second heating area 144 and the third heating area 146 may be indicated at respective positions corresponding to the positions of the first working coil 102, the second working coil 104, the inner working coil 106*a* and the outer working coil 106*b* on a surface of the top plate 106 of the cover plate 110 to correspond the position of the container to the positions of the working coils 102, 104, 106 and 106*b*.

An interface unit 108 may be provided inside the case 102. The interface unit 108 may have a function for allowing the user to apply power or adjusting the output of the working coils 102, 104, 106*a* and 106*b*, or displaying information related to the induction heating apparatus 10. Hereinafter, embodiments of the present disclosure will be described focusing on an embodiment in which the interface unit implemented as a touch panel allowing the user to input information and displaying information by touch, but the interface unit 108 may be implemented in a different form or structure.

In addition, a manipulation area 118 may be formed in a position corresponding to the interface unit 108 in the top plate 106 of the cover plate 110. Specific characters or images for user manipulation or information display may be displayed on the manipulation area 108. The user may perform a desired operation by manipulation (e.g., touch) a specific point of the manipulation area 118 with reference to the characteristics or images displayed on the manipulation area 118. For example, the power of the induction heating apparatus 10 may be turned on/off, the power level may be changed, or a heating start command or a heating end command may be input by the user's manipulation. In addition, on various types of information output by the interface unit 114 based on the user's manipulation or the operation of the induction heating apparatus 10 may be displayed through the manipulation area 118.

A power module (not show) for supplying power to the working coils 102, 104, 106*a* and 106*b* or the interface unit 114 may be provided in the space formed in the case 102. The power module may be electrically connected with the working coils 102, 104, 106*a* and 106*b* or the interface unit 108 and configure to convert the power applied by an external power source into power suitable for driving the working coils 102, 104, 106*a* and 106*b* or the interface unit 108 and supply the converted power to the working coils or the interface unit.

For reference, in the embodiment shown FIG. 3, four working coils 102, 104, 106*a* and 106*b* are disposed inside the case 102. According to embodiments, three or less or five or more working coils may be disposed inside the case 102.

Although not shown in FIG. 3, a controller (not shown) may be provided in the space formed inside the case 102. The controller (not shown) may be implemented to control the driving of the working coils 102, 104, 106*a* and 106*b* based on the user's command (e.g., the heating start command, the heating end command, the power level change command and the like) input through the interface unit 108 or adjust an output power value of the working coil 102, 104, 106*a* or 106*b*.

Figure 4:
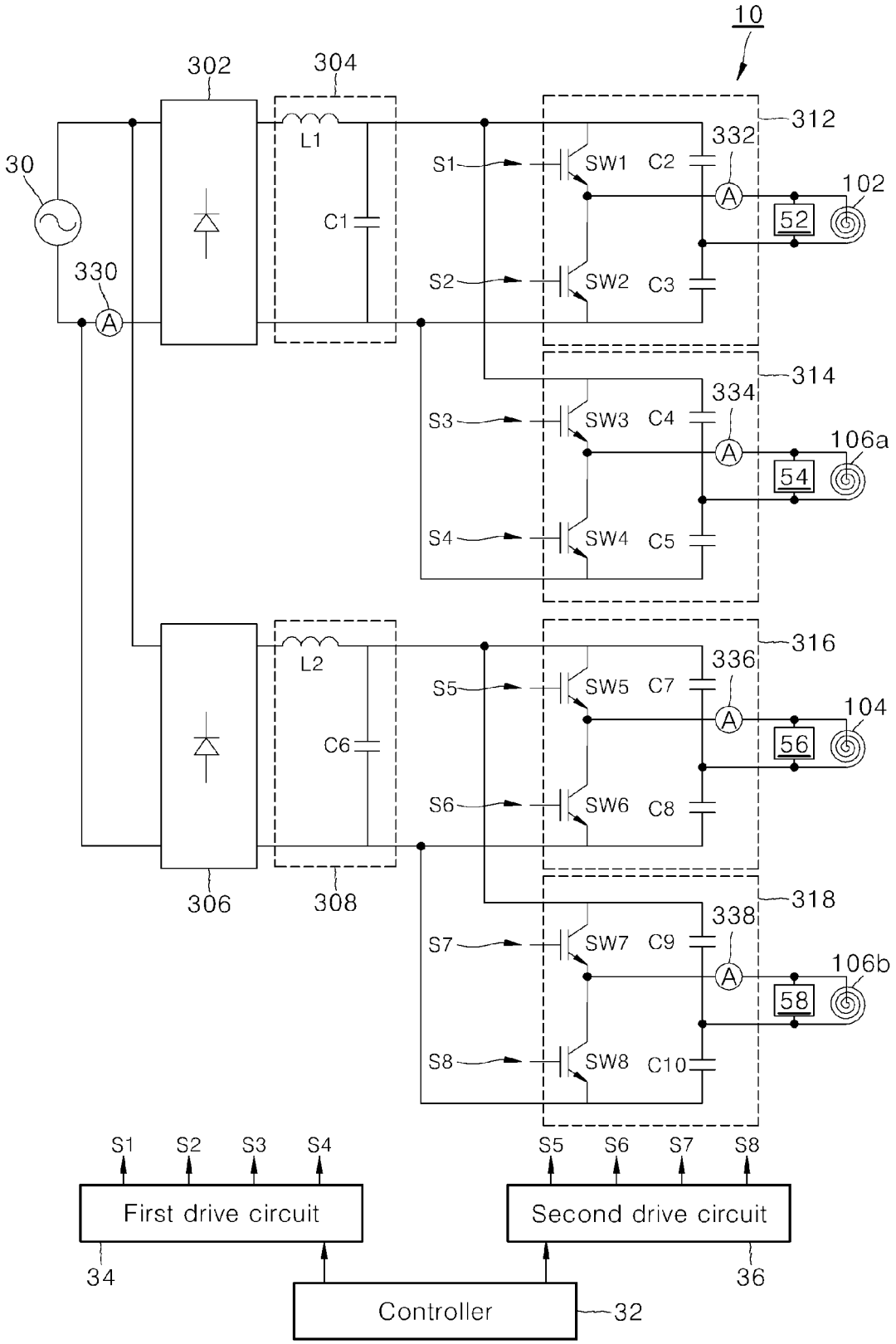
FIG. 4 is a circuit diagram of the induction heating apparatus according to one embodiment.

FIG. 4 is a circuit diagram of the induction heating apparatus according to one embodiment. Referring to FIG. 4, the induction heating apparatus 10 according to one embodiment may include a first rectifier circuit 302, a first smoothing circuit 304, a first inverter circuit 312, a second inverter circuit 314, a first working coil 12, an inner working coil 106*a*, a second rectifier circuit 306, a second smoothing circuit 308, a third inverter circuit 316, a fourth inverter circuit 318, a second working coil 104, an outer working coil 106*b*, a controller 32, a first drive circuit 34 and a second drive circuit 36.

The first rectifier circuit 302 and the second rectifier circuit 306 may be configured to rectify and output AC current supplied from an external power source 30. The first and rectifier circuit 302 and the second rectifier circuit 306 each may include a plurality of diode elements. Examples of the first rectifier circuit 302 and the second rectifier circuit 306 may include a bridge diode circuit, but are not limited thereto.

The first smoothing circuit 304 and the second smoothing circuit 308 may be configured to smooth the power output from the first rectifier circuit 302 and the second rectifier circuit 306, respectively, and convert the power into DC power and output the converted DC power. The first smoothing circuit 304 may include a first inductor L1 and a first DC link capacitor C1. The second smoothing circuit 308 may include a second inductor L2 and a second DC link capacitor C6.

The first inverter circuit 312 and the second inverter circuit 314 may convert the current output from the first smoothing circuit 304 and output an alternating current for driving the working coils 102 and 106*a*. In the present disclosure, it can be expressed that the first inverter circuit 312 and the second inverter circuit 314 share the first rectifier circuit 302 and the first smoothing circuit 304.

The first inverter 312 may include a first switching element SW1, a second switching element SW2, a first capacitor C2 and a second capacitor C3. The second inverter circuit 314 may include a third switching element SW3, a fourth switching element SW4, a third capacitor C4 and a fourth capacitor C5.

The first switching element SW1 and the second switching element SW2 may be connected in series with each other, and alternately turned on and off by a first switching signal S1 and a second switching signal S2 output from the first drive circuit 34. Such alternate turn-on and turn-off of the switching element may be referred to as 'switching operation'. Similarly, the third switching element SW3 and the fourth switching element SW4 may be connected in series with each other, and alternately turned on and off by a third switching signal S3 and a fourth switching signal S4 output from the first drive circuit 34.

The AC current output by the switching operation of the first switching element SW1 and the second switching element SW2 may drive the first working coil 102. The AC current output by the switching operation of the third switching element SW3 and the fourth switching element SW4 may drive the inner working coil 106*a*. When an alternating current is supplied to each working coil, an eddy current may flow through the container or vessel placed on the top of each working coil, and may heat it.

The third inverter 316 and the fourth inverter 318 may convert the current output from the second smoothing circuit 308 to output an alternating current for driving the working coils 104 and 106*b*. In embodiments of the present disclosure, it may be expressed that the third inverter circuit 316 and the fourth inverter circuit 318 share the second rectifier circuit 306 and the second smoothing circuit 308.

The third inverter circuit 316 may include a fifth switching element SW5, a sixth switching element SW6, a fifth capacitor C7 and a sixth capacitor C8. The fourth inverter circuit 318 may include a seventh switching element SW7, an eighth switching element SW8, a seventh capacitor C9 and an eighth capacitor C10.

The fifth switching element SW5 and the sixth switching element SW6 may be connected in series with each other, and alternately turned on and off by a fifth switching signal and a sixth switching signal S6 output from the second drive circuit 36.

An alternating current (AC) output by the switching operation of the fifth switching element SW5 and the sixth switching element SW6 may drive the second working coil 104. An alternating current output by the switching operation of the seventh switching element SW7 and the eighth switching element SW8 may drive the outer working coil 106*b*. when the alternating current is supplied to each working coil, an eddy current may flow through the container or vessel placed on the top of each working coil and the container may be heated.

The first drive circuit 34 may supply a first switching signal S1, a second switching signal S2, a third switching signal S3 and a fourth switching signal S4 to the first switching element SW1, the second switching element SW2, the third switching element SW3 and the fourth switching element SW4, respectively, based on the control signal supplied by the controller 32. The second drive circuit 36 may supply a fifth switching signal S5, a sixth switching signal S6, a seventh switching signal S7 and an eighth switching signal S8 to the fifth switching element SW5, the sixth switching element SW6, the seventh switching element SW7 and the eighth switching element SW8, respectively, based on the control signal supplied by the controller 32. The controller 32 may supply the control signal to the first drive circuit 34 and control the output of the switching signals S1, S2, S3 and S4 by the first drive circuit 34. Also, the controller 32 may apply the control signal to the second drive circuit 36 and control the output of the switching signals S5, S6, S7 and S8 by the second drive circuit 36. For example, the controller 32 may control the first driving circuit 34 to supply only the first switching signal S1 and the second switching signal S2 so that only the first working coil 102 can be supplied with power. Or, the controller 32 may control the first drive circuit 34 to supply all of the first switching signal S1, the second switching signal S2, the third switching signal S3 and the fourth switching signal S4, so that both the first working coil 102 and the inner working coil 106*a* can be supplied with power.

The controller 32 may also determine the driving frequency of each working coil, and supply the control signal to the first drive circuit 34 and the second drive circuit 36 based on the determined driving frequency of each working coil. The switching frequency of the switching signal output from the first drive circuit 34 and the second drive circuit may vary based on the driving frequency determined by the controller 32. In addition, a current output from each inverter circuit 312, 314, 316 and 318 and an output power value of each working coil may vary based on the switching frequency of the switching signal input to each inverter 312, 314, 316 and 318.

The induction heating apparatus 10 according to one embodiment may include an input current sensor 330. The input current sensor 330 may measure the magnitude of the input current input through the external power source 30 (i.e., the input current value), and transmit the measured input current value to the controller 32.

Further, the induction heating apparatus 10 according to one embodiment may include a first resonance current sensor 332, a second resonance current sensor 334, a third resonance current sensor 336 and a fourth resonance current sensor 334. When the first working coil 102, the inner working coil 106*a*, the second working coil 104 and the outer working coil 106*b* are driven, the first resonance current sensor 332, the second resonance current sensor 334, the third resonance current sensor 336 and the fourth resonance current sensor 338 may measure the magnitude of the resonance current flowing through the first working coil 102, the inner working coil 106*a*, the second working coil 104 and the outer working coil 106*b* (i.e., the resonance current value) and transmit the measured resonance current value to the controller 32.

The controller 32 may implement a protection operation for stopping the driving of each working coil, when the input current value or the resonance current value is greater than a predetermined reference value. In addition, the controller 32 may determine whether a heatable container is present in each heating area by performing a second container detection operation for each heating area based on at least one of an input current value and a resonance current value, as described below.

The induction heating apparatus 10 according to one embodiment of the present disclosure may include a first container detection circuit 52, a second container detection circuit 54, a third container detection circuit 56 and a fourth container detection circuit 58 which are connected with the first working coil 102, the inner working coil 106*a*, the second working coil 104 and the outer working coil 106*b*, respectively.

The first container circuit 52, the second container detection circuit 54, the third container detection circuit 56 and the fourth container detection circuit 58 may be configured to sense a first container detection operation which will be described later. The first container detection circuit 52, the second container detection circuit 54, the third container detection circuit 56 and the fourth container detection circuit 58 may supply sensing current to the first working coil 102, the inner working coil 106*a*, the second working coil 104 and the outer working coil 106*b* based on the control of the controller 32, and output a square wave based on a resonance signal generated when the sensing current flows. The controller 32 may determine whether a container exists in each heating area based on the square waves output by the first container detection circuit 52, the second container detection circuit 54, the third container detection circuit 56 and the fourth container detection circuit 58, respectively.

Figure 5:
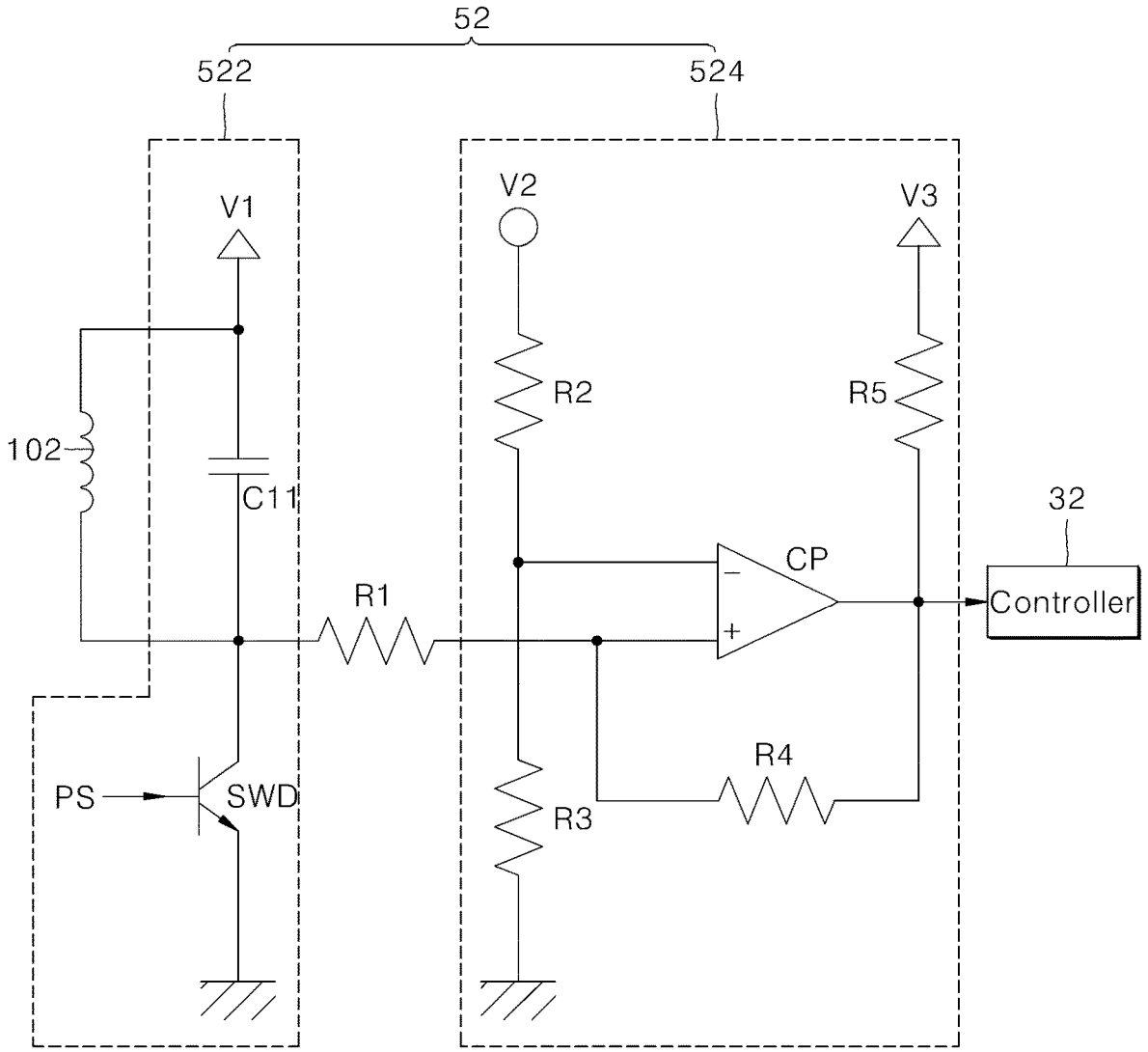
FIG. 5 is a circuit diagram of a container detection circuit according to one embodiment.

FIG. 5 is a circuit diagram of a container detection circuit according to one embodiment.

FIG. 5 illustrates a circuit diagram of the first container detection circuit 52. Although not shown in the drawing, the second container detection circuit 54, the third container detection circuit 56 and the fourth container detection circuit 58 may also be implemented in the same way as the circuit diagram shown in FIG. 5.

Referring to FIG. 5, the first container detection circuit 52 according to one embodiment of the present disclosure may include a resonance signal generation circuit 522 and a resonance signal conversion circuit 524.

The resonance signal generation signal 522 may include a capacitor C11 connected in parallel with the first working coil 102. The first working coil 102 and the capacitor C11 may be connected between a ground terminal and a first power source V1 for supplying current to the first working coil 102 and the capacitor C11.

Also, a switching element SWD may be connected between the first working coil 102 and the capacitor C11 and the ground terminal. When the first container detection operation starts, the switching element SWD may be turned on by the switching signal PS, and a current having a predetermined amplitude and phase may flow through the first working coil 102 and the capacitor C11. When the first container detection operation is performed, an instantaneous current may be supplied to the first working coil 102 and the capacitor C11 for a very short time (e.g., 0.1 second or less).

When current flows in the first working coil 102 and the capacitor C11 by the power supplied from the first power source V1 based on the switching operation of the switching element SWD, the first working coil 102 and the capacitor C11 may cause autonomous resonance phenomenon (i.e., LC resonance). Due to such a resonance phenomenon, the resonance signal that decay with time may be generated, and the generated resonance signal may be input to a comparator CP provided in the resonance signal conversion circuit 524.

The resonance signal conversion circuit 524 may compare the resonance signal generated by the resonance signal generation circuit 522 with a reference signal to generate a square wave. The resonance signal conversion circuit 524 may include a comparator CP configured to compare the resonance signal generated by the resonance signal generation circuit 522 with a reference signal generated by a second power source V2 and output the comparison result.

More specifically, the comparator CP may compare the voltage level of the reference signal generated by the second power source V2 with the voltage level of the resonance signal generated by the resonance signal generation circuit 522, and output signals (i.e., square waves) having different levels of voltages based on the comparison result. For example, when the voltage level of the resonance signal generated by the resonance generation circuit 522 is greater than or equal to the voltage level of a reference signal, the comparator CP may output a signal having a voltage level of a first level (e.g., 5V). When the voltage level of the resonance signal is less than the voltage level of the reference signal, the comparator CP may output a signal having a voltage level of a second level (e.g., 0V).

At this time, the voltage level of the reference signal generated by the second power source V2 may be set differently by adjusting the size of voltage dividing resistors R2 and R3

The controller 32 may count the number of the waveforms of the square wave output from the resonance signal conversion circuit 524, and determine whether a container exists in the heating area corresponding to the working coil 204 based on the counted number of the wave forms of the square wave. In the embodiments of the present disclosure, the number of the waveforms of the square wave output from the resonance signal conversion circuit 524 may be referred to as a 'sensing value'.

Hereinafter, referring to FIGS. 6 to 9 will be described a pattern of the square wave output by the resonance signal conversion circuit 524 and a pattern of the resonance signal generated by the resonance generation circuit 522, when there is a usable container near the container detection circuit and when there is no useable container near the container detection circuit.

Figure 6:
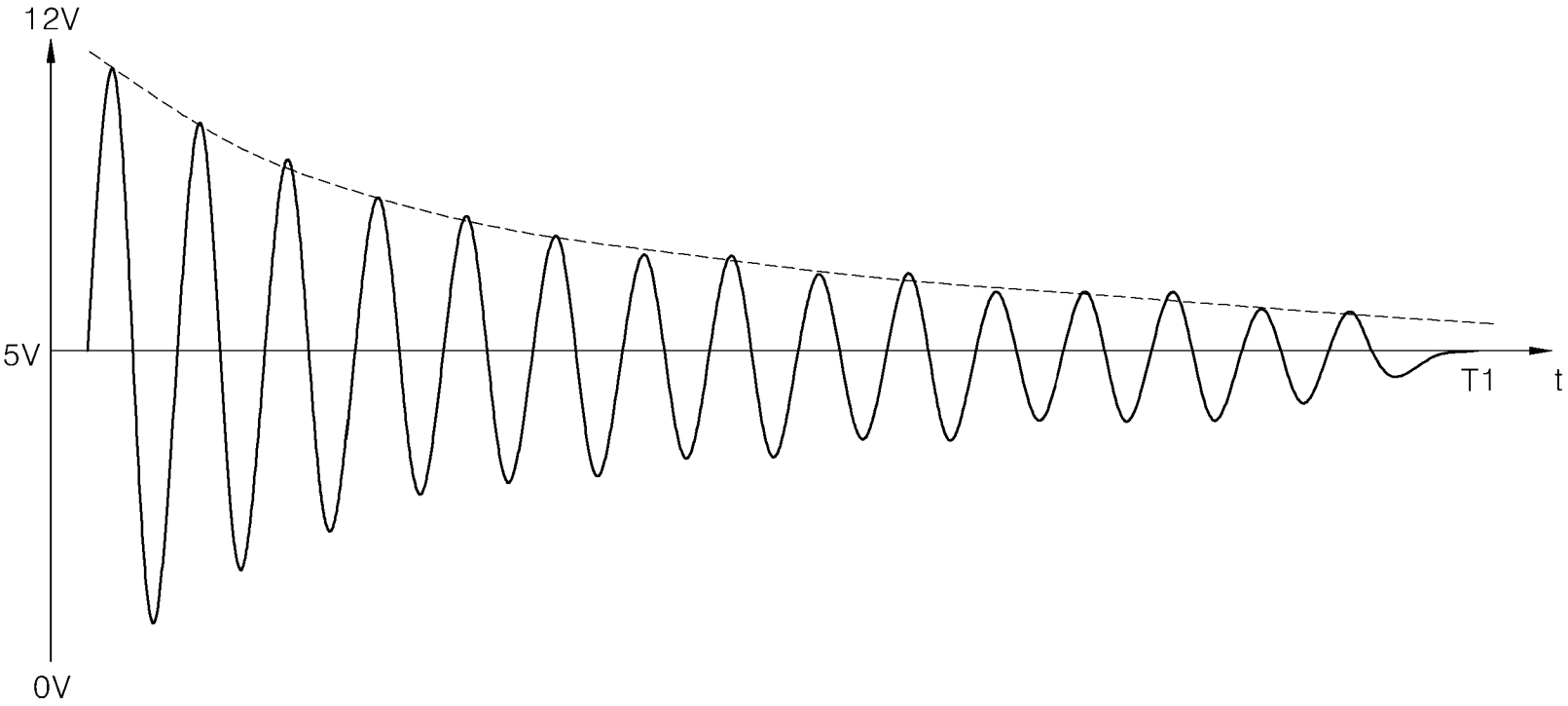
FIG. 6 is a diagram illustrating a waveform of a resonance signal output by a resonance signal generation circuit when no container exists in a heating area in one embodiment of the present disclosure.
Figure 7:
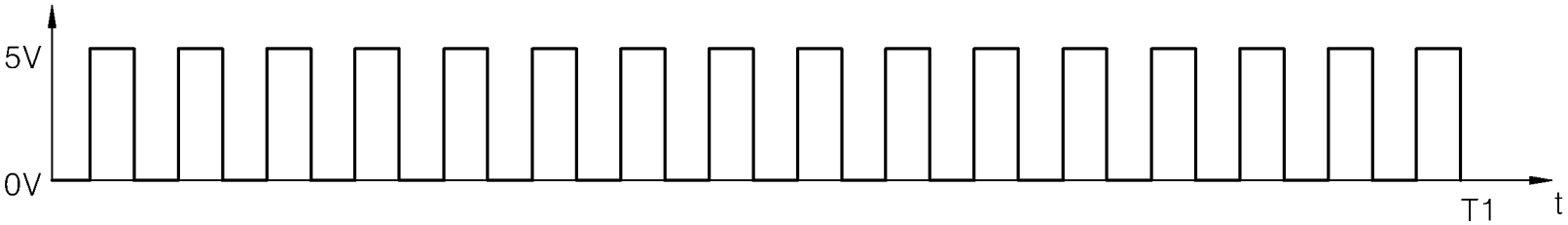
FIG. 7 is a diagram illustrating a waveform of a square wave output when a resonance signal conversion circuit converts the resonance signal shown in FIG. 6.

FIG. 6 shows the waveform of the resonance signal output by the resonance signal generation circuit when there is no container in the heating area according to one embodiment. FIG. 7 shows the waveform of the square output when the resonance signal conversion circuit converts the resonance signal shown in FIG. 6.

Referring to FIG. 6, when the container detection operation starts based on the control of the controller 32 in a state where no usable container exists near the container detection circuit according to the present disclosure, the switching element SWD may be turned on and current having the predetermined amplitude and size may be supplied to the first working coil 102 and the capacitor C11. Due to such current supply, the first working coil 102 and the capacitor C11 may have autonomous resonance phenomenon. Accordingly, the resonance signal generation circuit 522 may output a resonance signal that is attenuated according to time t as shown in FIG. 6.

When there is no usable container or vessel near the container detection circuit according to the present disclosure, the impedance of the first working coil 102 and the capacitor C11 circuit may be maintained relatively low, compared to the case where there is a useable container. Accordingly, as shown in FIG. 6, the resonance signal output by the resonance signal generation circuit 522 may be attenuated for a relatively long time and then disappear at time T1. The comparator CP of the resonance signal conversion circuit 524 receiving the resonance signal as shown in FIG. 6 may compare the voltage level of the input resonance signal with the voltage level of the reference signal (e.g., 5V). Hence, the comparator CP may output a signal of a first level (e.g., 5V) only when the voltage level of the resonance signal is equal to or greater than the voltage level of the reference signal, and output a signal of a second level (e.g., 0V) otherwise.

Figure 12:
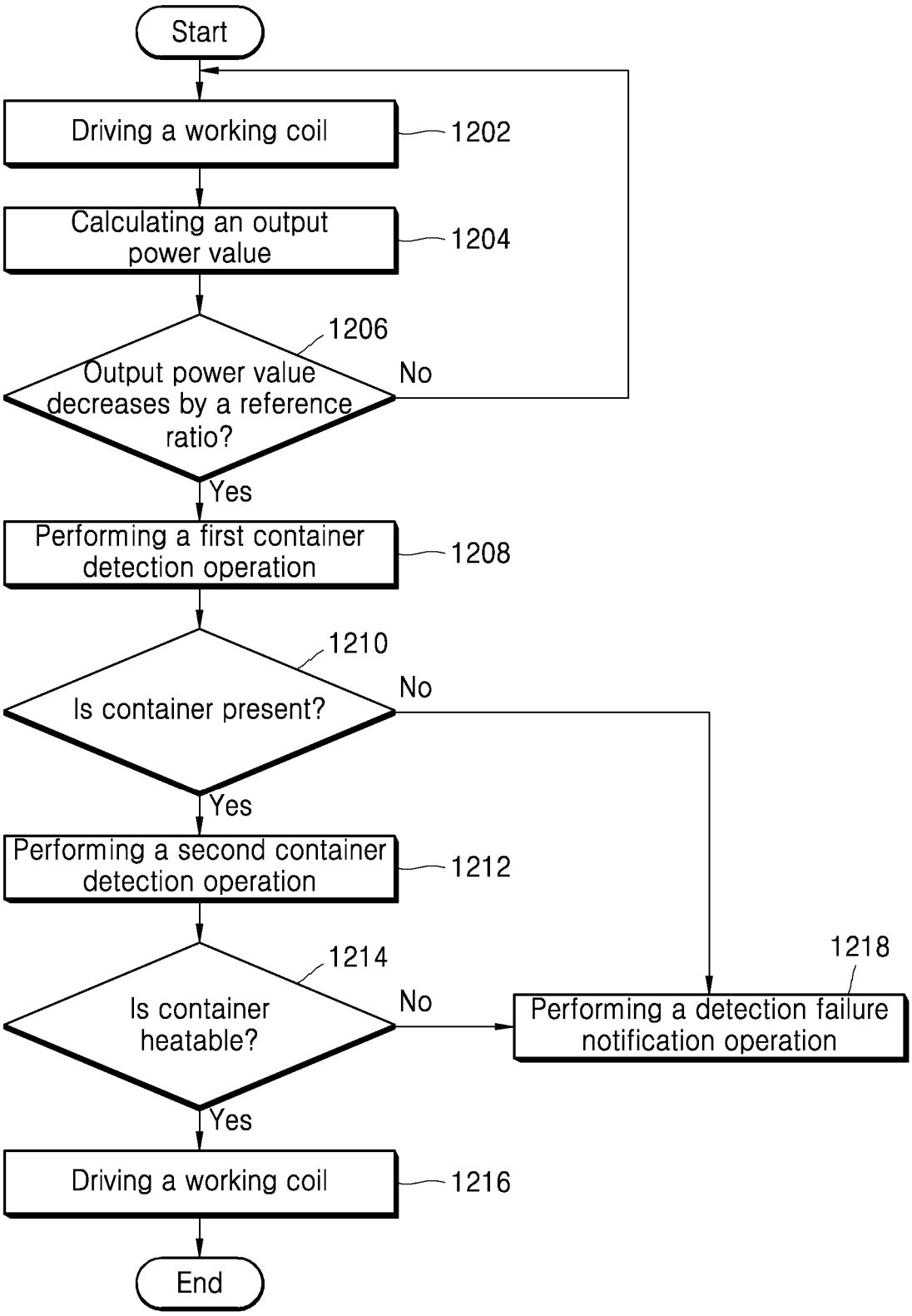
FIG. 12 is a flow chart illustrating a method for controlling the induction heating apparatus according to a further embodiment of the present disclosure.

The waveform according to the signal output of such the comparator CP may be a square wave shown in FIG. 12. In the embodiment of FIG. 7, a total of sixteen square waves may be generated from the start of the first container detection operation to the time T1.

Figure 8:
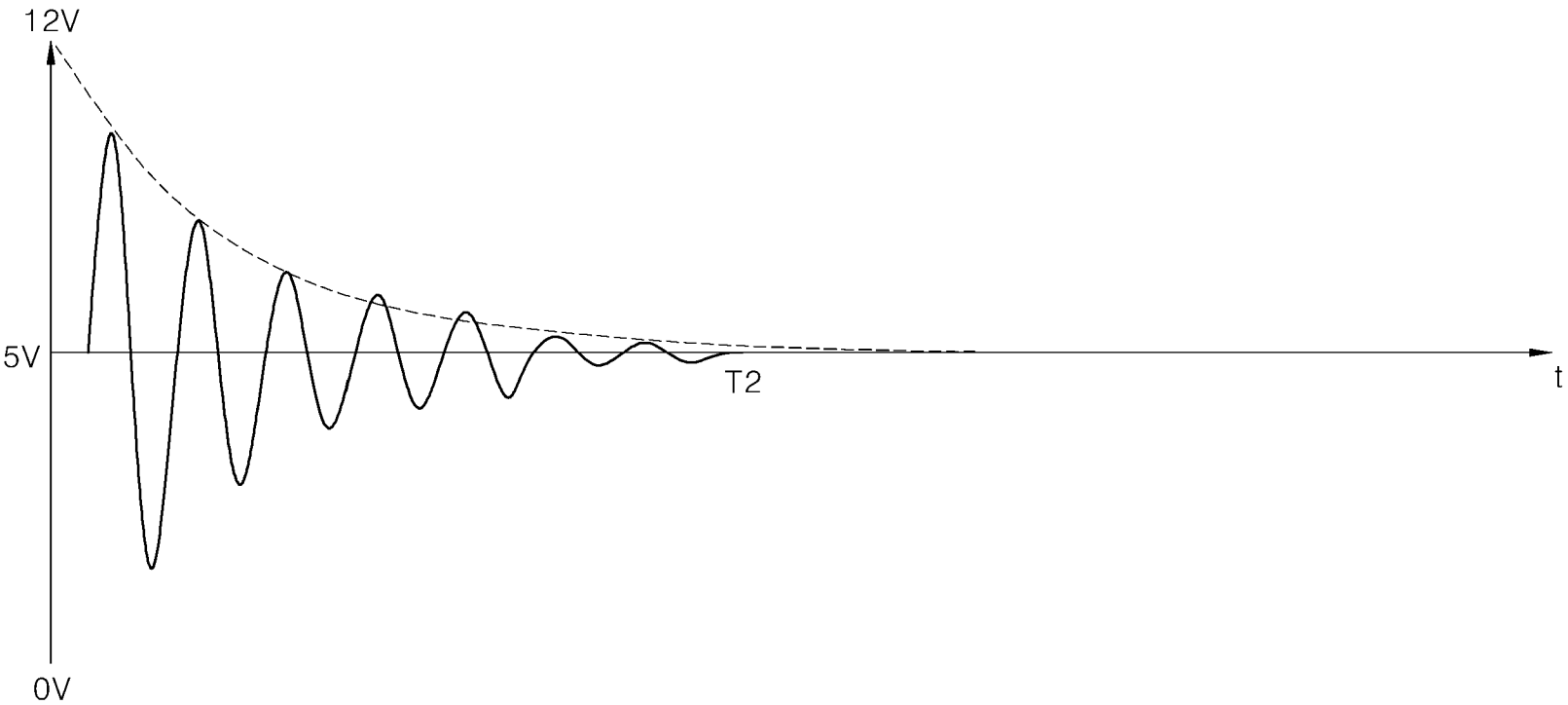
FIG. 8 is a diagram illustrating a waveform of a resonance signal output by a resonance signal generation circuit when a container is present in a heating area in one embodiment of the present disclosure.
Figure 9:
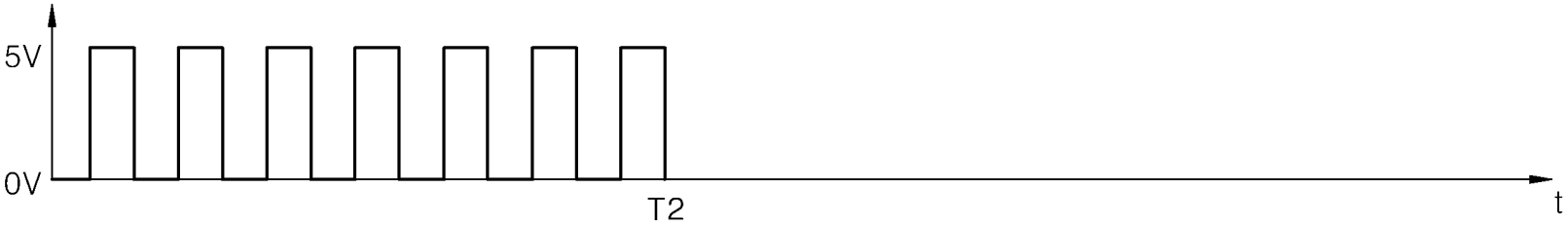
FIG. 9 is a diagram illustrating a waveform of a square wave output when a resonance signal conversion circuit converts the resonance signal shown in FIG. 8.

FIG. 8 shows the waveform of the resonance signal output by the resonance generation circuit when there is a container in the heating area. FIG. 9 shows the waveform of the resonance signal output when the resonance signal conversion circuit converts the resonance signal shown in FIG. 8.

Referring to FIG. 8, when the first container detection operation starts in a state where there is a useable container near the container detection circuit according to the present disclosure, the switching element SWD may be turned on and current having a predetermined amplitude and size may be supplied to the first working coil 102 and the capacitor C11. Due to such current supply, the first working coil 102 and the capacitor C11 may have autonomous resonance phenomenon. Accordingly, the resonance signal generation circuit 522 may output a resonance signal that is attenuated according to time t as shown in FIG. 8.

When there is a usable container or vessel near the container detection circuit according to the present disclosure, the impedance of the first working coil 102 and the capacitor C11 circuit may be maintained relatively high, compared to the case where there is no useable container. Accordingly, as shown in FIG. 8, the resonance signal output by the resonance signal generation circuit 522 may be attenuated for a relatively short time and then disappear at time T2.

The comparator CP of the resonance signal conversion circuit 524 receiving the resonance signal as shown in FIG. 8 may compare the voltage level of the input resonance signal with the voltage level of the reference signal (e.g., 5V). Hence, the comparator CP may output a signal of a first level (e.g., 5V) only when the voltage level of the resonance signal is equal to or greater than the voltage level of the reference signal, and output a signal of a second level (e.g., 0V) otherwise. The waveform according to the signal output of such the comparator CP may be a square wave shown in FIG. 9. In the embodiment of FIG. 9, a total of seven square waves may be generated from the start of the first container detection operation to the time T2.

As a result, as described with reference to FIG. 9, when there is not usable container in the heating area, the number of the waveforms of the square wave output by the resonance signal conversion circuit 524 (i.e., the sensing value) may be larger than the number of the waveforms of the square wave output by the resonance signal conversion circuit 524 when there is a useable container in the heating area.

Accordingly, the controller 32 may implement the first container detection operation configured to determine presence of the container placed on the heating area corresponding to the working coil 204 based on the number of the waveforms of the square wave (i.e., the sensing value) output from the container detection circuits 52, 54, 56 and 58. For example, the controller 32 may determine that a container exists in the heating area corresponding to the working coil 204 when the counted number of the waveforms of the square wave (i.e., the sensing value) is a predetermined reference value or less, and that no container exists in the heating area corresponding to the working coil 204 when the sensing value is over the predetermined reference value.

When the first container detection operation is performed as described above, a sensing current may be supplied to the working coil for a very short sensing time (e.g., 0.1 seconds or less) through the container detection circuits 52, 54, 56 and 58. Accordingly, while the first container for a specific heating area is performed, the driving of the working coil disposed in the other heating area may not be stopped.

Meanwhile, the controller 32 may determine presence of a heatable container in the heating area by performing a second container detection operation. In one embodiment of the present disclosure, the controller 32 may perform the second container detection operation based on at least one of the input current measured by an input current sensor 330 and the resonance current measured by the resonance current sensors 332, 334, 336 and 338 when the working coil is driven at a predetermined sensing frequency (e.g., 65 kHz).

For example, when performing the second container detection operation for the first heating area corresponding to the first working coil 102, the controller 32 may set a driving frequency of the first working coil 102 to a predetermined sensing frequency (e.g., 65 kHz) and drive the first working coil 102 for a predetermined sensing time (e.g., 10 seconds).

The controller 32 may determine that no container exists in the first heating area, when the resonance current value measured while the first working coil 102 is driven at the sensing frequency is greater than a predetermined reference value. Conversely, when the value of the resonance current measured while the first working coil 102 is driven at the sensing frequency is less than the predetermined value, the controller 32 may determine that a heatable container is present in the first heating area.

As another example, the controller 32 may determine that no heatable container is present in the first heating area when a predetermined ratio of the input current value to the resonance current value measured while the first working coil 102 is driven at the sensing frequency is less than a predetermined reference value. Conversely, when a ratio of the input current value to the resonance current value measured while the first working coil 102 is driven at the sensing frequency is larger than a predetermined reference value, the controller 32 may determine that there is a heatable container in the heating area.

As a further example, the controller 32 may determine whether a heatable container exists in the first heating area based on the input current value measured while the first working coil 102 is driven at the sensing frequency. As a still further example, the controller 32 may determine presence of a heatable container in the first heating area based on whether the ratio of the input current value to the resonance current value (i.e., the input current value/resonance current value) and the resonance current value satisfy a predetermined reference.

When an arbitrary container is determined as a heatable container by the second container detection operation, the container may be defined as having induction heating characteristics.

While the above-mentioned second container detection operation is performed, the working coil has to be driven at the sensing frequency for a relatively long time (e.g., 10 seconds). Accordingly, the driving of the working coil arranged in the heating area in which the second container detection operation is performed (e.g., the first working coil 102), the other working coil sharing the rectifier circuit 302 or 306 and the smoothing circuit 304 or 308 (e.g., the inner working coil 106*a*) may be stopped while the second container detection operation is performed. When the working coil of which the driving is stopped at this time is the inner working coil 106*a*, the driving of the outer working coil 106*b* may be also stopped. When the working coil of which the driving is stopped is the outer coil 106*b*, the driving of the inner working coil 106*a* may be also stopped.

Hereinafter, embodiments for a control method of the induction heating apparatus according to the resent disclosure to reduce the noise generated during the container detection operation in the induction heating apparatus will be described.

Figure 10:
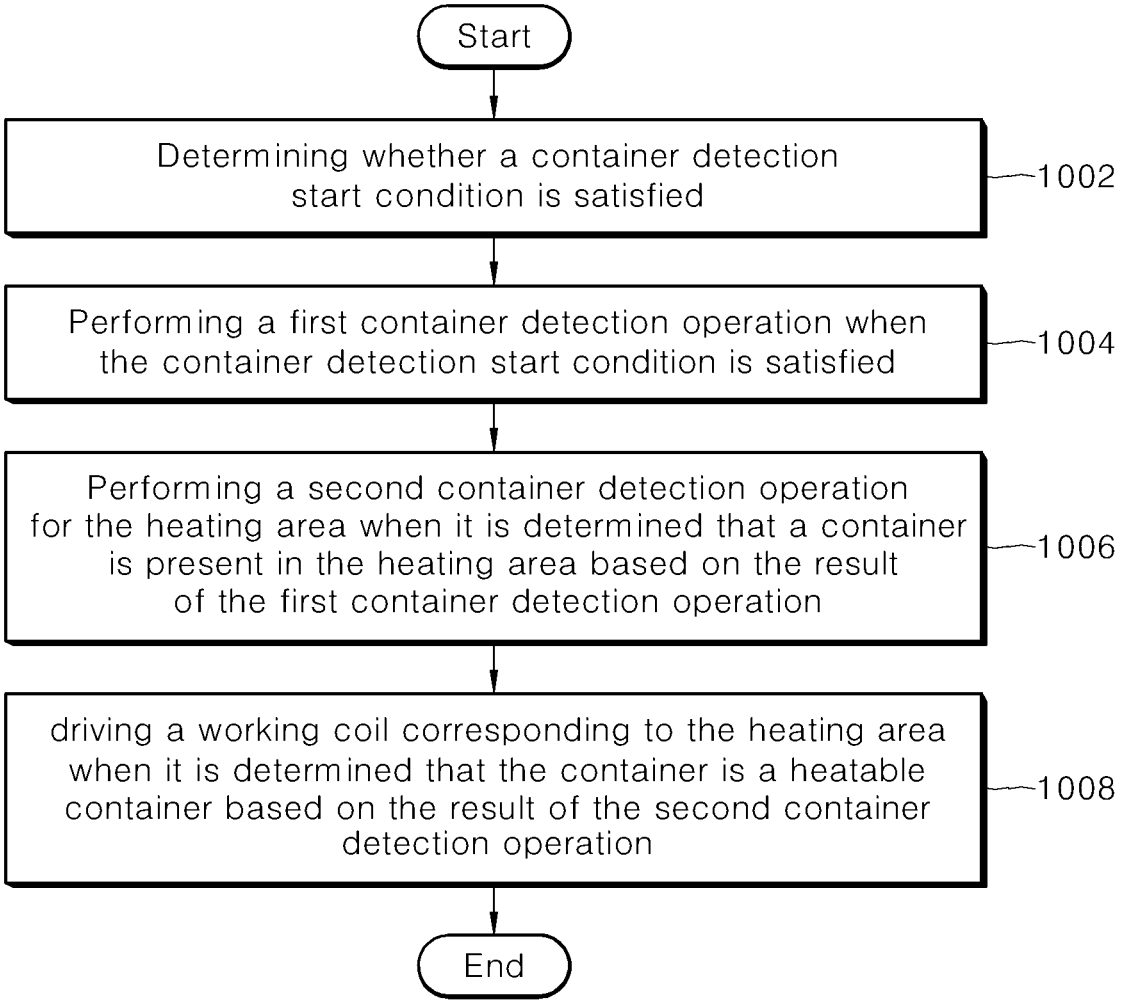
FIG. 10 is a flow chart illustrating a method for controlling the induction heating apparatus according to one embodiment of the present disclosure.

FIG. 10 is a flow chart illustrating a control method of the induction heating apparatus according to one embodiment.

Referring to FIG. 10, the controller 32 of the induction heating apparatus 10 according to one embodiment may determine whether a container detection start condition is satisfied (1002). In one embodiment of the present disclosure, the step of determining whether the container detection start condition is satisfied may include a step of determining that the container detection start condition is satisfied when a heating start command for the heating area is input. In another embodiment of the present disclosure, the step of determining whether the container detection start condition is satisfied (1002) may include a step of determining that the container detection start condition is satisfied when the output power value of the working coil corresponding to the heating area decreases as much as a predetermined reference ratio.

Once the container detection start condition is satisfied, the controller 32 may perform the first container detection operation for the heating area (1004). In the prior art, a second container detection operation is performed for the heating area. However, in the embodiment of the present disclosure, the first container detection operation may be performed primarily, so that it may be determined whether a container is put in the heating area.

Once it is determined that a container is put in the heating area based on the result of the first container detection operation, the controller 32 may perform the second container detection operation for the heating area (1006).

When it is determined that the container put in the heating area is a heatable one based on the result of the second container detection operation, the controller 32 may drive the working coil corresponding to the heating area (1008), thereby heating the container put in the heating area. Although not shown in the drawings, controller 32 may perform a detection failure notification operation if it is determined that no container is put in the heating area based on the result of the first container detection operation performed in the step (1004) or that the container put in the heating area is not a heatable container based on the result of the second container detection operation performed in the step (1006).

Figure 11:
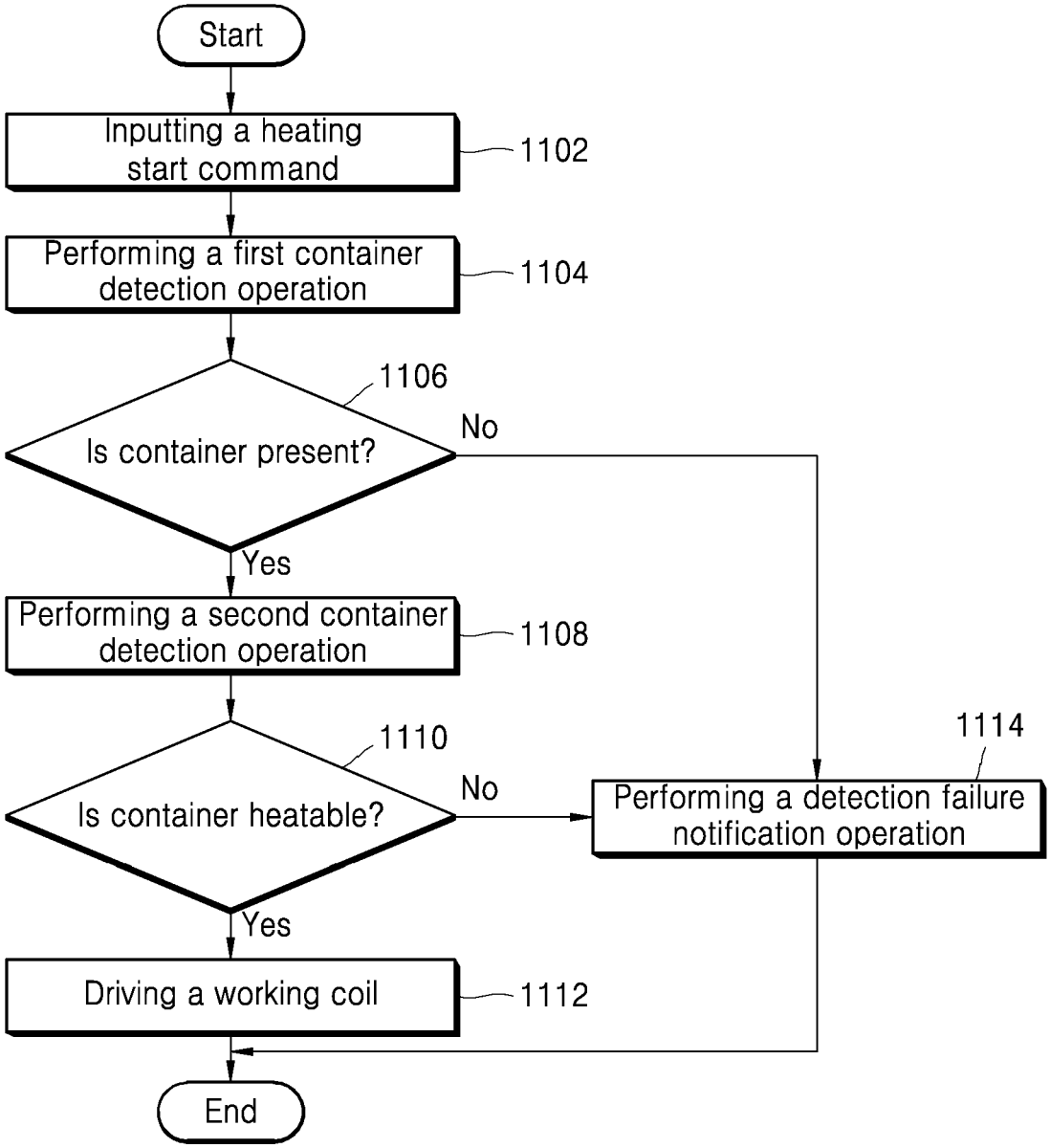
FIG. 11 is a flow chart illustrating a method for controlling the induction heating apparatus according to another embodiment of the present disclosure.

FIG. 11 is a flow chart illustrating a control method of the induction heating apparatus according to another embodiment of the present disclosure.

Referring to FIG. 11, the user may input a heating start command for the first heating area 142 by setting a power level of the first heating area 142 through the interface unit 108. The controller 32 may receive an input of a heating start command for the first heating area 142 through the interface unit 108.

Once the heating start command for the first heating area 142 is input, the controller 32 may determine that the container detection start condition is satisfied and then perform the first container detection operation (1104). The controller 32 may turn on the switching element SWD of the first container detection circuit 52 and supply the sensing current to the first working coil 102 and the capacitor C11 for the sensing time (e.g., 0.1 second or less). The other working coils driven during the first container detection operation may maintain the driving state without stopping the driving.

The controller 32 may determine whether a container is present in the first heating area 142 based on the number of the waveforms of the square wave output from the first container detection circuit 52 based on the first container detection operation (1106). In one embodiment of the present disclosure, the controller 32 may repeatedly perform the first container detection operation a predetermined number of times (e.g., three times).

When it is determined in the step (1106) that no container is present in the first heating area 142, the controller 32 may perform the detection failure notification operation (1114). For example, when it is determined that no container is present in the first heating area 142, the controller 32 may display a letter (e.g., 'U') indicating that there is no container in the first heating area through the interface unit 108.

As another example, the controller 32 may repeatedly perform the first container detection for a predetermined reference time (e.g., 30 seconds). When it is determined that no container is present in even after the first container detection operation a predetermined reference number of times (e.g., three times), the controller 32 may display a letter (e.g., 'U') indicating no container in the first heating area 142 through the interface unit 108 and continuously perform the first container detection operation until the reference time has elapsed. If it is determined that no container is present in the first heating area 142 even after the reference time has elapsed, the controller 32 may control no letter to be displayed on the interface unit 108 and terminate the container detection.

This detection failure notification operation may allow the user to easily and quickly recognize that cooling is impossible because there is no container in the first heating area 142.

Referring back to FIG. 11, if it is determined that a container is present in the first heating area 142 in the step (1106), the controller 32 may perform the second container detection for the first heating area 142 (1108).

In one embodiment of the present disclosure, the second container detection operation may be performed only once or twice, but the number of times the second container detection operation is performed may be variable according to embodiments.

When it is determined in the step (1110) that the container put in the first heating area 142 is a heatable container, the controller 32 may perform the detection failure notification operation (1114).

When it is determined in the step (1110) that the container put in the first heating area 142 is a heatable container, the controller 32 may drive the first working coil 102 (1112), thereby heating the container put in the first heating area 142.

FIG. 12 is a flow chart illustrating a control method of the induction heating apparatus according a further embodiment of the present disclosure.

Referring to FIG. 12, the first working coil 102 may be driven based on the user's heating start command (1202).

The controller 32 may calculate an output power value of the first working coil 102 when the first working coil 102 is driven (1204).

The controller 32 may determine whether the output power value of the first working coil 102 decreases as much as the predetermined reference ratio (e.g., 50%) (1206).

If the distance between the center of the first working coil 102 and the center of the container increases by the user's moving of the container while the container is heated by the first working coil, or if the container is removed from the first heating area 142 by the user, the output power value of the first working coil 102 may decrease drastically.

Accordingly, the controller 32 may determine that normal cooking is impossible because the container put in the first heating area 142 is moved or removed, when the output power value of the first working coil 102 drastically decreases as much as the predetermined reference ratio. In this instance, the controller 32 may determine that the container detection start condition is satisfied.

Once it is determined that the output power value of the first working coil 102 does not decrease by the predetermined reference ratio, the controller 32 may return to the step (1202).

Once it is determined that the output power value of the first working coil 102 decreases as much as the predetermined reference ratio, the controller 32 may determine that the container detection start condition is satisfied and perform the first container detection operation (1208).

The controller 32 may determine whether a container or vessel is present in the first heating area 142 based on the number of the waveforms of the square wave output from the first container detection circuit 52 based on the result of the first container detection operation (1210). In one embodiment, the controller 32 may repeatedly perform the first container detection operation a predetermined number of times (e.g., three times).

Once it is determined that no container is present in the first heating area 142 in the step (1210), the controller 32 may perform the detection failure notification operation (1218). For example, when it is determined that no container is present in the first heating area 142, the controller 32 may display the letter (e.g., 'U') indicating that no container is present in the first heating area 142 through the interface unit 108.

As another example, the controller 32 may repeatedly perform the first container detection operation for the predetermined reference time (e.g., 30 seconds). The controller 32 may display the letter (e.g., 'U') indicating that not container is present in the first heating area 142 through the interface unit 108, once it is determined that no container is present even after the first container detection operation is performed a predetermined number of times (e.g., three times), and continuously perform the first container detection operation until the reference time has elapsed. If it is determined that no container is present in the first heating area 142 even after the reference time, the controller 32 may control no letter to be displayed on the interface unit 108 and terminate the container detection operation.

Due to such the detection failure notification operation, the user may easily and quickly recognize that cooking is impossible because there is no container in the first heating area 142. Referring back to FIG. 12, when it is determined in the step (1210) that a container or vessel is present in the first heating area 142, the controller 32 may perform the second container detection operation for the first heating area 142 (1212).

In the embodiment, the second container detection operation may be performed only once or twice, but the number of times the second container detection operation is performed may be variable according to embodiments. The controller 32 may determine whether the container or vessel put in the first heating area 142 is a heatable container based on the result of the second container detection operation (1214).

When it is determined in the step (1214) that the container or vessel put in the first heating area 142 is not a heatable container, the controller 32 may perform the detection failure notification operation (1218).

When it is determined in the step (1214) that the container or vessel put in the first heating area 142 is a heatable container, the controller 32 may drive the first working coil 102 (1216), thereby heating the container put in the first heating area 142.

According to one embodiment of the present disclosure, when it is determined that no container is present by the first container detection operation, the second container detection operation may not be performed but the detection failure notification operation may be performed. As mentioned above, the first container detection operation may be performed for a relatively short time, compared with the second container detection operation so that the driving of the other working coils does not have to be stopped. Accordingly, the noise generated while the conventional second container detection is performed may not be generated when no container or vessel is present in the heating area.

In addition, according to one embodiment of the present disclosure, only the first container detection operation that consumes relatively less power in a state where no container is present in the heating area. When a container is present in the heating area, the second container detection operation may not be performed repeatedly, thereby reducing the power consumed by the container detection operation, compared with the prior art.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A method for controlling an induction heating apparatus, comprising:

determining whether a container detection start condition is satisfied;

performing a first container detection operation for a heating area when the container detection start condition is determined to be satisfied;

performing a second container detection operation for the heating area when a container is determined to be present in the heating area based on a result of the first container detection operation; and driving a working coil corresponding to the heating area when the container is determined to be a heatable container based on a result of the second container detection operation.

2. The method for controlling the induction heating apparatus of claim 1, wherein the determining whether the container detection start condition is satisfied comprises determining that the container detection start condition is satisfied when a heating start command for the heating area is input.

3. The method for controlling the induction heating apparatus of claim 1, wherein the determining whether the container detection start condition is satisfied comprises determining that the container detection start condition is satisfied when an output power value of the working coil corresponding to the heating area decreases by at least a predetermined reference ratio.

4. The method for controlling the induction heating apparatus of claim 1, wherein the performing of the second container detection operation comprises:

setting a driving frequency for the working coil to a predetermined sensing frequency; and determining whether the container is a heatable container based on at least one of a resonance current value or an input current value determined when the working coil is driven based on the sensing frequency.

5. The method for controlling the induction heating apparatus of claim 1, wherein the performing of the second container detection operation comprises:

determining whether the container is a heatable container based on at least one of a resonance current value and an input current value determined when the working coil is driven.

6. The method for controlling the induction heating apparatus of claim 1, further comprising:

performing a detection failure notification operation when no container is determined to be present in the heating area or the container is determined to not be a heatable container.

7. The method for controlling the induction heating apparatus of claim 1, wherein the performing of the first container detection operation comprises:

providing a sensing current having a predetermined amplitude and size to the working coil;

converting a resonance signal, generated based on the sensing current, into a square waveform having a plurality of cycles;

determining whether the container is present in the heating area based on a number of the cycles of the square waveform.

8. An induction heating apparatus comprising:

a working coil disposed to correspond to a heating area;

an inverter circuit including a plurality of switching elements, and configured to supply current to the working coil; and a drive circuit configured to supply switching signals to respective switching elements of the inverter circuit; and wherein a controller is configured to:

determine that a container start condition is satisfied, and perform a first container detection operation for a heating area when the container detection start condition is determined to be satisfied, and perform a second container detection operation for the heating area when a container is determined to be present in the heating area based on a result of the first container detection operation, drive a working coil corresponding to the heating area when the container is determined to be a heatable container based on a result of the second container detection operation.

9. The induction heating apparatus of claim 8, wherein the controller is configured to determine that the container detection start condition is satisfied when a heating start command for the heating area is input.

10. The induction heating apparatus of claim 8, wherein the controller is configured to determine that the container detection start condition is satisfied when an output power value of the working coil corresponding to the heating area decreases by at least a predetermined reference ratio.

11. The induction heating apparatus of claim 8, wherein the performing of the second container detection operation includes the controller being configured to:

set a driving frequency for the working coil to a predetermined sensing frequency; and determine whether the container is a heatable container based on at least one of a resonance current value or an input current value determined when the working coil is driven based on the sensing frequency.

12. The induction heating apparatus of claim 8, wherein the performing of the second container detection operation includes the controller being configured to:

determine whether the container is a heatable container based on at least one of a resonance current value and an input current value determined when the working coil is driven.

13. The induction heating apparatus of claim 8, wherein the controller is configured to perform a detection failure notification operation when no container is determined to be present in the heating area or the container is determined to not be a heatable container.

14. The induction heating apparatus of claim 8, wherein the performing of the first container detection operation comprises the controller configured to:

provide a sensing current having a predetermined amplitude and size to the working coil;

convert a resonance signal, based on the sensing current, into a square waveform having a plurality of cycles;

determine whether a container is present in the heating area based on a number of the cycles of the square waveform.

* * * * *